United States Patent [19]

Nishi et al.

[11] Patent Number: 4,808,245

[45] Date of Patent: Feb. 28, 1989

[54] METHOD FOR DRAWING IRON AND STEEL WIRE ROD

[75] Inventors: Eiichi Nishi, Osaka; Fumio Aso, Kyoto; Hiroyoshi Nakagawa, Osaka, all of Japan

[73] Assignee: Nihon Parkerizing Co., LTD., Tokyo, Japan

[21] Appl. No.: 116,087

[22] Filed: Nov. 3, 1987

[30] Foreign Application Priority Data

Nov. 10, 1986 [JP] Japan ..... 61-265656

[51] Int. Cl.[4] ..... C23C 22/80

[52] U.S. Cl. ..... 148/6.15 R; 72/42; 427/327

[58] Field of Search ..... 148/6.15 R, 6.15 T; 72/42; 427/327

[56] References Cited

U.S. PATENT DOCUMENTS 2,490,062 12/1949 Jerstedt ..... 148/6.15 R

*Primary Examiner*—Sam Silverburg

*Attorney, Agent, or Firm*—Ernest G. Szoke; Wayne C. Jaeschke; Real J. Grandmaison

[57] ABSTRACT

An improved method for drawing iron or steel rod subjects the rod to a titanium based conditioning agent prior to application of a dry powder soap lubricant and subsequent to descaling and any phosphating step.

2 Claims, No Drawings

METHOD FOR DRAWING IRON AND STEEL WIRE ROD

BACKGROUND OF THE INVENTION

The present invention concerns a method for drawing iron and steel wire rod. More particularly, it concerns an improvement of the pretreatment method where wire drawing is conducted by using a dry lubricant.

The pretreatment process for iron and steel rod prior to wire drawing hitherto employed generally comprises descaling such as shot blasting, polishing, pickling etc. or phosphate conversion treatment after descaling/neutralizing/temporary rust preventive treatment/drying-/lubrication treatment. This pretreatment process typically consists of degreasing and water rinsing of iron and steel rod if needed, pickling with dilute acid of HCl or $H_2SO_4$ for descaling, water rinsing, neutralization, temporary rust prevention treatment, drying. After that, the wire rod is drawn by using powder lubricant. The drawn wire coated with rust preventive oil for the purpose of temporary rust protection is delivered to the user, where it is drawn into sewing-machine needles, springs, bicycle spokes, etc. which may then be cleaned, water rinsed, pickled and plated. As the abovementioned neutralizing/temporary rust preventive treatment solution, in general, "lime-soap" solution prepared by mixing/dissolving quick lime and needle-shaped soap into water is used while maintaining its temperature at 50°–80° C.

Another lubrication treatment is to use liquid lubricant in place of powder lubricant. As to such lubricant, there are metal soap solution type and mixed aqueous solution of sodium phosphate, borax and titanium oxide (Japanese patent publication Sho No. 30-2358), which are all publicly known. The metal soap solution type is accompanied by viscosity rise during use, often leading to the lack of uniform coating formation or insufficient drying, and eventually resulting in insufficient lubrication effect. For this reason, powder lubrication mentioned earlier is in common use.

Powder lubricant is, in general, formulated with metal soap of various kinds as the base and inorganic substances like lime, etc. with addition thereto of sulphur, $MoS_2$, etc. Such powder lubricant is filled in a box in front of drawing die and used to pass iron and steel wire rod therethrough and to form lubricant film on steel surface.

The present invention attempts to solve the problems arising from pretreatment of iron and steel rod to be wire-drawn with use of a powder lubricant.

In the abovementioned case, if the drawing process is performed without sufficient lubricity, surface defects take place. If the drawn products are intended for, e.g., sewing-machine needle or others that require stringent surface finishing accuracy, the condition is to be with no defect under microscopic observation of 2000 magnification. Any defect or surface irregularity may lead to a rough surface of plated film and eventually result in impaired appearance of the final products. Therefore, in drawing iron and steel rods, the higher the cosmetic grade required for the final products, the more stringent becomes the need for the lubricant performance.

Lubricity of the powder lubricant is affected by the composition. Even in case of using a metal soap of high quality, sometimes so-called hair line defects may take place on drawn products during processing.

Further in case bar in coil form to be drawn is left standing for long time after having been pickled, neutralized and temporary rust prevention treated, it is often the case that rust develops and the neutralization/temporary rust preventive coating absorbs water. As a remedy, reprocessing with pickling-neutralization/temporary rust prevention is sometimes done. The problem still remains, however, that the "lime soap" film of neutralization/temporary rust prevention is hard to remove.

Surface conditioning chemicals for use prior to phosphate conversion treatment are publicly known (e.g. Japanese Patent Publications Nos. Sho 39-7125, Sho 58-55529 and Sho 60-41148: U.S. Pat. No. 2,310,239 and U.S. Pat. No. 2,874,081), wherein the basic constituent is colloidal titanium compound and alkaline phosphate. The fundamental function is to activate or condition the substrate metal surface for the formation of uniform, fine and dense phosphate coating. In the present invention, the exact function of the surface conditioning agent known for use prior to phosphate conversion treatment (herein after referred to as surface conditioner) to the intermediate process before metal soap treatment of wire rod and after pickling or phosphate treatment thereof remains unclear. Presumably, the film of surface conditioner existing between steel wire surface and metal soap film plays a role in retaining metal soap powder particles in a more favorable state. When wire is drawn and compared between the cases with and without use of the surface conditioner, the former shows requirement of reduced drawing power, with extremely reduced damage occurrence frequency; also such phenomena are observable that the colloidal titanium compound remains on wire surface even after drawing.

SUMMARY OF THE INVENTION

It has now been discovered that if metal rod is subjected to a titanium conditioning agent after pickling and/or phosphating and before soap application, the drawn product has superior quality.

DETAILED DESCRIPTION OF THE INVENTION

As the surface conditioner, publicly-known compounds are used in the present invention. As alkaline phosphate, a polyphosphate is preferable as it serves to stabilize the compound in a colloidal state. As polyphosphate, salts of sodium, potassium, ammonium or the like of metaphosphoric acid or pyrophosphoric acid is particularly preferable. As colloidal compound, titanium compound is the best, but those of Ni, Sn, Co, Mo, Pb, Zn etc. are also acknowledged for their effect. The surface conditioner can also contain, besides the abovementioned colloidal titanium compounds and alkaline phosphates, such additives as perborate, carbonate, orthophosphate and watersoluble anionic organic compound (Japanese Patent Appln. No. Sho 60-99278). As to the preparation of the surface conditioner, the same manufacture method as in the abovementioned conventional technology is usable. In regard to the content of each constituent in the surface conditioner, it is to be adjusted to the extent with which the required effect can be obtained. In case the surface conditioner is too high or too low in each of its components, the effect on improving lubricity becomes unattainable to the extent that present invention aims at, as in the case of surface conditioning for phosphate conversion treatment. It should be noted here, however, that the present invention does not require so stringent restriction to be placed on the content of each component of surface conditioner as in the case of surface conditioning for phosphate conversion treatment. Taking economical aspects also into account, the amount of colloidal titanium compound as titanium within 0.001–0.5 g/l and the amount of alkaline phosphate within 0.1–50 g/l preferably 2–30 g/l can provide satisfactory lubrication performance. Also as to the pH of surface conditioner, the restriction is not so stringent as in the case of that for phosphate conversion treatment (Ref: Japanese Patent Publication No. Sho 58-55229) and a range from 5.7 to 9.5 is available. Further, in order to cope with possible pH lowering of surface conditioner taking place due to carried-over acid still remaining on iron and steel wire rod surface after pickling and phosphate treatment, and from viewpoint of preventing such wire rod from rusting, use of surface conditioner higher than 8 in the pH is preferable. As to the surface conditioning temperature, preferable range is 50°–80° C. in order to provide the work with required heat for drying after the treatment. As to treating time, a range from 2 to 3 minutes is satisfactory.

After the treatment with the abovementioned surface conditioner, drawing is accomplished by applying metal soap as the lubricant. As such metal soap, public-known substances are usable. The present invention employs a dry system that uses powdery metal soap. There is no specific range in the powder particle size. As metal soap, calcium stearate is used in general. To mention "lime soap", it is incapable of alleviating defects of drawn wire even with application of the present invention's surface conditioner, therefore it is unusable for the present invention. In view of the remarkably low price, however, blending a small quantity of "lime-soap" and metal soap is allowable which helps reduce the operating cost of lubricant for wire drawing. Blending public-known additives other than metal soaps is also available.

Besides the pretreatment with surface conditioner and lubrication treatment with metal soap explained above, other treatment stages (pickling, phosphate conversion treatment) follows the same way as in the system hitherto used. Intermediate steps such as neutralization and water rinsing are applied according to the necessity in the same way as in the system conventionally in use.

EXAMPLE 1

Steel bar in coil (quality: SWRCH 62A, diameter: 4 mm) processed with water rinsing, pickling (15% HCl, ambient temperature) and water rinsing in this sequence was treated with a surface conditioner based on the present invention. This surface conditioner was prepared by using titanyl sulphate and disodium phosphate in the way that dispersed titanyl sulphate solution cooled to 20° C. was mixed with disodium phosphate, which was adjusted to pH 8.5 with sulphuric acid to form a slurry. This slurry was dried at 100°–120° C. until its water content was lower than 1.5%, then pulverized. The powder was dissolved in water and the composition was adjusted to the following.

| | |
|---|---|
| Colloidal titanium compound (as titanium) | 0.1 g/l |
| As disodium phosphate | 7 g/l |
| pH | 8.5 |
| Temperature | 60–70° C. |

Into such surface conditioning solution was immersed steel bar in coil at ambient temperature for 1 minute. After drying, the coil was subjected to wire drawing by passing it through drawing die box filled with powder metal soap (Trade name: KOSHIN, main constituent: calcium stearate) then through 7 drawing dies with final drawing speed of 300 m/min and with reduction of diameter to 2 mm. The conditioning of the drawn surface was observed with a microscope (magnification: 2000) for a cross-section of the drawn rod. No surface defects nor skin scratches were observed. The surface quality together with excellent surface brightness was evaluated as superior to the conventional products.

For comparison purposes, drawing was conducted following the same conditions as abovementioned except for the surface conditioner which was replaced by "lime-soap" aqueous liquid of 10% content (60°–70° C.). The result was evaluated as inferior in surface detects and surface brightness so that obtained by the surface conditioner of the present invention.

EXAMPLE 2

Example 1 was repeated except that steel bar in coil (SWRS 82A, 8 mmϕ) was phosphated with Bonderite 421 WD (product of Nihon Parkerizing Co., Ltd.) at 70° C. for 10 minutes followed by water rinsing and surface conditioner treatment. The steel bar thus treated was passed through 7 drawing dies with final drawing speed of 140 m/min to reduce it to 3.7 mmϕ. The drawn wire was observed in the same way as in Example 1, and indicated no surface defects. The grade of skin roughness and brightness was higher than in the conventional method.

EXAMPLE 3

Steel bar in coil (SWRS 82A, 2.6 mmϕ) subjected to the same treatment as in Example 1 was passed through 9 drawing dies with final drawing speed of 400 m/min and reduced to 1 mmϕ. The observation conducted in the same way as in Example 1 gave the result that the surface quality with no defects and with higher grade of skin roughness and brightness was evaluated as superior to the conventional.

EXAMPLE 4

Steel bar in coil (SWRS 100A, 2.4 mmϕ), after pickling (15% HCl, ambient temperature) and water rinsing, was treated with a surface conditioner prepared on the base of the present invention, as follows. A mixture having:

| | |
|---|---|
| Titanyl sulphate | 5 in weight ratio |
| Anhydrous disodium phosphate | 55 in weight ratio |
| Anhydrous sodium pyrophosphate | 15 in weight ratio |
| Water | 15 in weight ratio |

was heated at 100°–120° C. and its water content became lower than 1.5% (about 2 hr.). Powder thus obtained was mixed into water to get an aqueous solution of 20 g/l, which was adjusted to pH 9 by adding sodium carbonate thereinto, whereby a composition containing 0.02 g/l of colloidal titanium compound as titanium, 0.83 g/l of phosphate ion and 0.22 g/l of pyrophosphate ion was obtained.

Steel bar in coil, immersed in the abovementioned surface conditioner at an ambient temperature for 1 minute and then dried was subjected to drawing. Drawing was conducted by passing the coil through drawing die box filled with powder metal soap (trade name: KOSHIN, main component: calcium stearate) and through 6 dies successively with final drawing speed of 100 m/min and the diameter was reduced to 1.64 mmϕ. The drawn wire was observed in the same way as in Example 1 and no surface defects were observed with superior grade of surface roughness and brightness to the conventional.

EXAMPLE 5

Steel bar in coil (SWR S82A, 12 mmϕ) treated in the same way as in Example 4 was passed through 10 dies with final drawing speed of 100 m/min and reduced to 45 mmϕ. As a result of observation made in the same way as in Example 1, the grade of surface roughness and brightness were superior to the conventional. The wire product prepared in this way could be used as a final product meeting the specification of SWPB-S.

According to the methods as in Examples 1–5, bar in coil amounting to 10 tons in total was drawn to wire. All these products were better in brightness than those obtained according to the conventional processes.

As can be seen from the Examples described in the above, it is evident that the present invention can offer a method of drawing iron and steel rod which is remarkably effective in improving the surface quality (surface defects, appearance). Drawn wire having such high surface quality when subsequently plated can satisfy with ease even the most stringent specifications required.

Further, when re-pretreatment is required due to long standing time between surface conditioning and wire drawing, the coating thickness of the surface conditioner is thinner than that of conventional "lime-soap" process acts permitting easy removability with pickling.

What is claimed is:

1. A method for drawing iron or steel wire rod in which the iron or steel wire rod is treated with a sequence comprising descaling, contacting said wire rod with a surface conditioning chemical composition comprising colloidal titanium compound having titanium within 0.001–0.5 g/l and 0.1–50 g/l alkaline phosphate, drying said wire rod and then contacting said surface conditioned wire rod with a dry a powdered metal soap lubricant.

2. A process according to claim 1 wherein after descaling and prior to the contacting with the surface conditioning chemical composition said wire rod is phosphated.

* * * * *